United States Patent [19]

Skinner

[11] Patent Number: 4,632,489

[45] Date of Patent: Dec. 30, 1986

[54] HOOD FOR ELECTRONIC CABLE CONNECTOR

[75] Inventor: Michael J. Skinner, Tampa, Fla.

[73] Assignee: Custom Cable Assemblies, Inc., Tampa, Fla.

[21] Appl. No.: 802,532

[22] Filed: Nov. 27, 1985

[51] Int. Cl.[4] ..... H01R 13/58

[52] U.S. Cl. ..... 339/103 R; 339/107

[58] Field of Search ..... 339/103 R, 103 M, 105, 339/107, 179

[56] References Cited

U.S. PATENT DOCUMENTS

| | | | |
|---|---|---|---|
| 2,590,886 | 4/1952 | Pedersen | 339/107 |
| 3,845,457 | 10/1974 | Reimer | 339/274 X |
| 4,210,380 | 7/1980 | Brzostek | 339/107 |
| 4,323,725 | 4/1982 | Müller | 339/103 R X |
| 4,436,361 | 3/1984 | McCleerey | 339/97 |
| 4,549,780 | 10/1985 | Bertini et al. | 339/103 M X |

OTHER PUBLICATIONS

AMP Product Marketing Bulletin, No. B31, 3/85—AMP Special Industries.

*Primary Examiner*—Eugene F. Desmond
*Attorney, Agent, or Firm*—Pettis & McDonald

[57] ABSTRACT

A cable connector hood includes a housing formed of two mating portions and including at least one gripper element pivotably receivable within that housing and pivotally mounted for movement into gripping engagement with a cable connected to a cable connector received within the hood. Detent structure provides for resilient engagement between the gripper and the housing to maintain the gripper in engagement with the cable.

16 Claims, 11 Drawing Figures

HOOD FOR ELECTRONIC CABLE CONNECTOR

BACKGROUND OF THE INVENTION

This invention relates generally to the field of connectors for use with electronic cables, and more specifically to hoods for partially enclosing such connectors. More particularly it relates to such a hood which receives and partially encloses such a connector and grippingly engages a portion of an electronic cable connected to such connector.

In various electronics applications multiple pin or contact connectors are widely used to join multiple wire cables to other cables and to electronic devices. Frequently the cables to be connected comprise a large number (frequently several dozen) small diameter wires each of which is relatively delicate in its connection to the appropriate multiple pin connector. Accordingly, it is desirable to enclose the back side of the such a connector, where such delicate cable wires are connected thereto, within a hood that supports both the connector and a portion of the cable. It is particularly desirable to provide in such a hood some means for engaging the overall cable and thus relieving any strain that otherwise might be transmitted to the joint between the cable wires and the multiple wire connector.

In the past various types of such hoods have been provided. These have customarily been fabricated from metal or from synthetic resins. These hoods have provided various arrangements for receiving and holding a multiple wire connector and have included cable strain relief provisions that have clamped the cable to or within the hood in various manners. Such cable strain reliefs have taken various forms, including collars to be tightened about the cable by threaded fasteners, wedges that are forced into gripping engagement with the cable adjacent the entrance of the cable into the hood, and gripping blocks that slide along linear passages within the hood that extend generally transverse to the direction of the cable, with those blocks being slid into gripping engagement with the cable and held there by various forms of detents.

While various of these clamping arrangements have provided for satisfactory strain relief, most have required the use of various tools to effect their engagement in a manner strong enough to retain the cables. While the tools required have been as simple as screwdrivers or as complex as specially configured pliers, the requirement for such tool creates an inconvenience and extra burden upon those fabricating cable assemblies. When the hoods have been assembled without such necessary tools, the gripping force exerted upon the cable has frequently been insufficient to hold the cable firmly.

SUMMARY OF THE INVENTION

It is an object of the present invention to overcome certain of the difficulties suffered by prior art cable connector hoods and to provide such a hood that permits rapid assembly with a minimum requirement for tools. To achieve this object and others that will become apparent from the following description, this invention provides a hood for receiving and partially enclosing an electronic cable connector and for grippingly engaging a portion of an electronic cable connected to such connector. This hood includes a housing for receiving and partially enclosing the cable connector, with such housing having two spaced apart and generally opposed side portions with lateral edge portions extending therebetween, and including a first aperture through a first such lateral edge portion for receiving the cable connector and a second aperture through a second lateral edge portion for defining a cable channel and receiving the cable portion therethrough while restraining within the housing the movement of the cable transverse to the length of the cable. This housing comprises two mating housing portions, each including one of the first side portions and part of the lateral edge portions, a housing portion joining arrangement engagable with the housing portions for maintaining the housing portions in mating engagements with one another, at least one pivot support carried by at least one such housing portion and spaced from the cable channel, such pivot support having a pivot axis extending generally normal to that one housing portion first side portion, and detent structure carried by at least one of such housing portions and spaced from the pivot support. The hood further comprises at least one gripper element pivotably receivable onto the housing portion pivot support. This gripper element comprises a member having a first portion carrying a pivot structure including a predetermined pivot axis for pivotally engaging the housing portion pivot support and having a second, generally opposing, portion carrying detent engaging structure for resiliently engaging the housing portion detent structure when the gripper element is pivotally supported upon the housing portion pivot support. This gripper element is pivotable about that pivot support inwardly of the housing portions into gripping engagement with the cable portion.

In a preferred embodiment of this hood, described in detail below, the entire hood may be assembled by hand and without the use of any tools, the parts simply snapping together. In the preferred embodiment the pivotally mounted gripper element may be brought into gripping engagement with the cable portion by the person assembling the hoods simply applying hand pressure to those gripper elements.

DESCRIPTION OF THE DRAWINGS

Particularly preferred embodiments of the apparatus of this invention will be described in detail in connection with the illustrations in which.

DESCRIPTION OF PREFERRED EMBODIMENT

Figure 1:
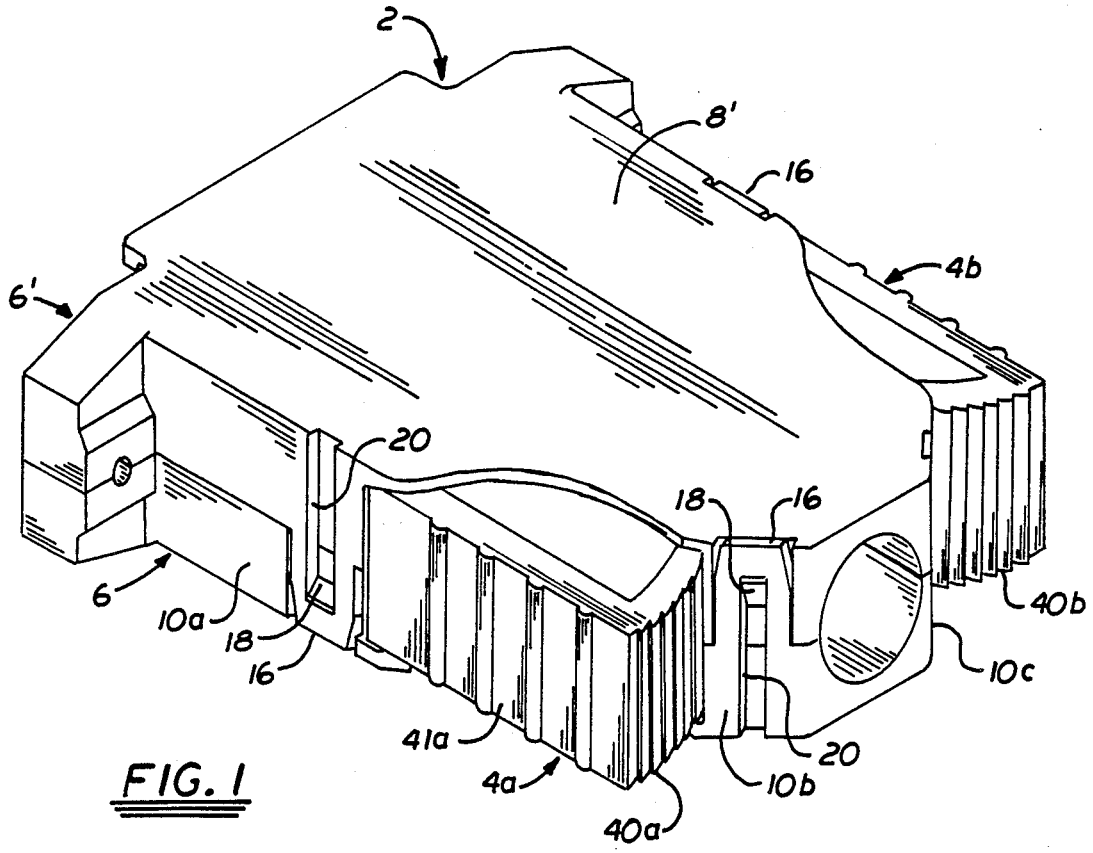
FIG. 1 is a rear perspective view of the cable connector hood of the present invention.
Figure 2:
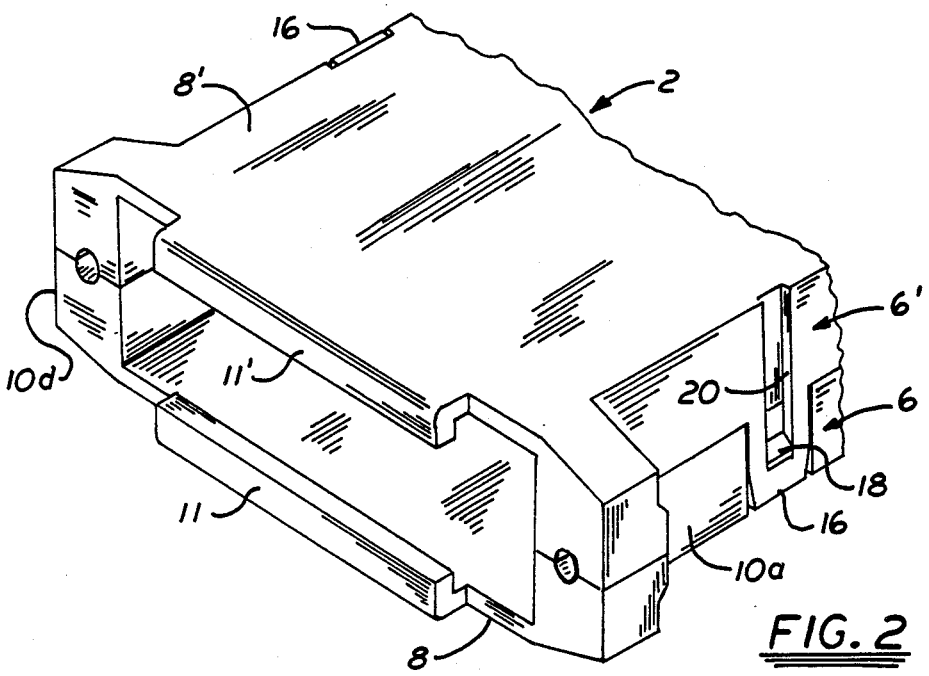
FIG. 2 is a partial front perspective view of the cable connector hood of FIG. 1.
Figure 3:
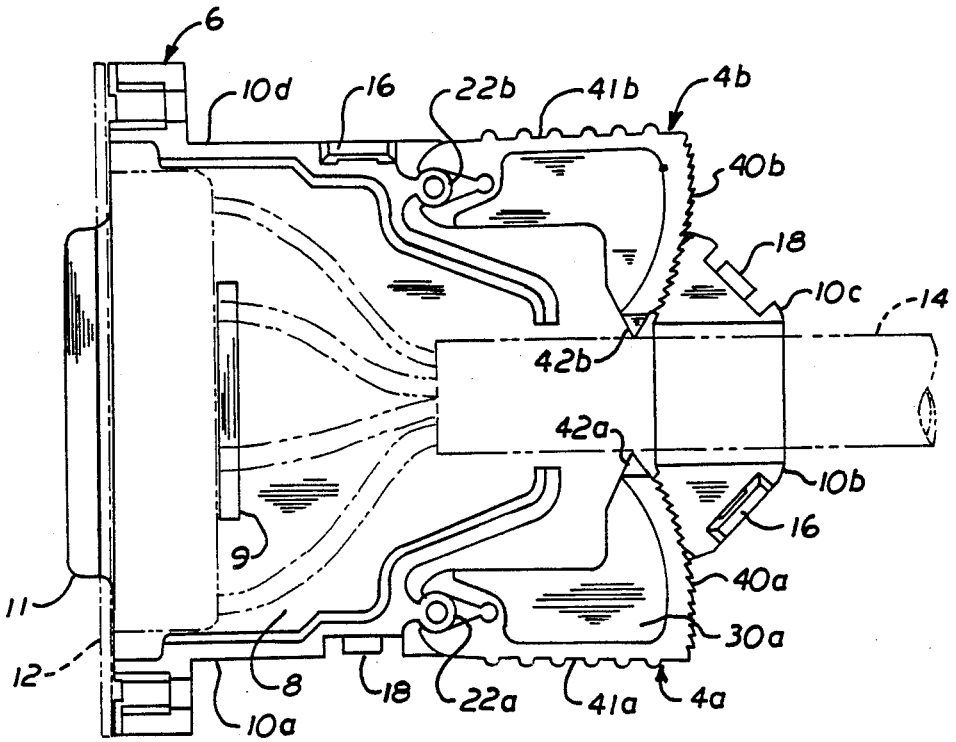
FIG. 3 is a top plan view of one of the two housing portions and including two gripper elements of the hood of FIG. 1, with those gripper elements pivoted away from gripping engagement with a cable, shown in phantom used in connection with that housing.
Figure 4:
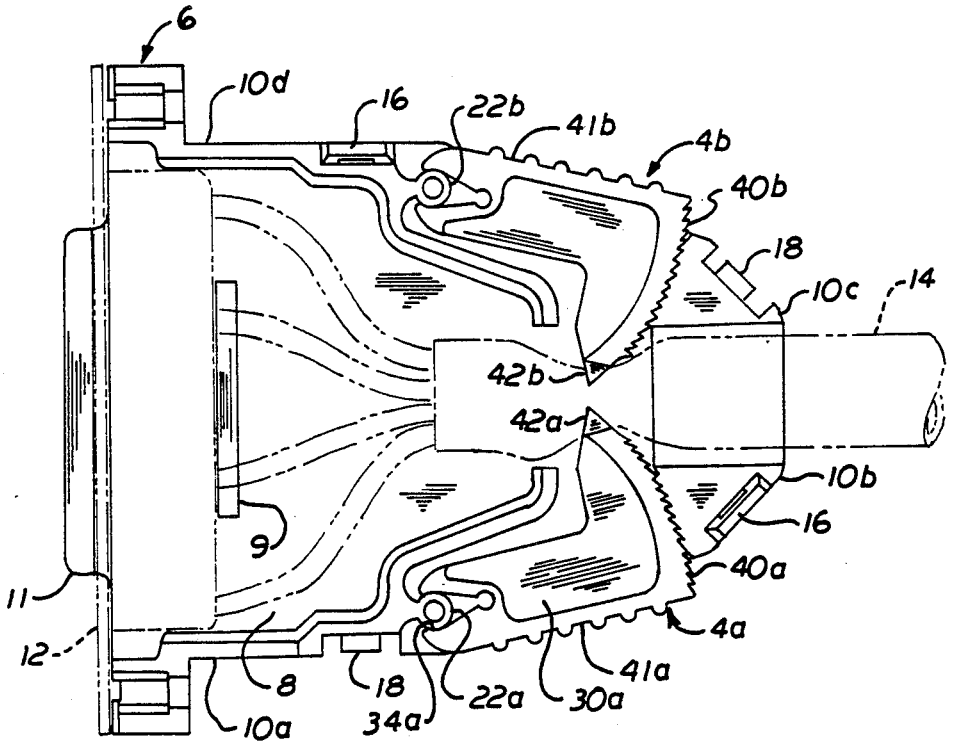
FIG. 4 is a top plan view similar to FIG. 3 but with the gripper elements pivoted inwardly into a cable gripping position.

A particularly preferred embodiment of the connector hood of this invention is best illustrated in the perspective views of FIGS. 1 and 2 and the partially assembled plan views of FIGS. 3 and 4. In general, this hood comprises a housing, generally indicated by reference numeral 2 and at least one gripper element 4. Preferably, and illustrated in this preferred embodiment, the hood assembly includes two such gripper elements 4*a* and 4*b*, although it should be obvious that the illustrated apparatus might function, albeit less efficiently, with a single such gripper element 4*a*. Preferably the housing and the gripper elements are all formed of a suitable synthetic resin, which may desirably be a material such as that known by the trademark "Nylon 66."

Figure 5:
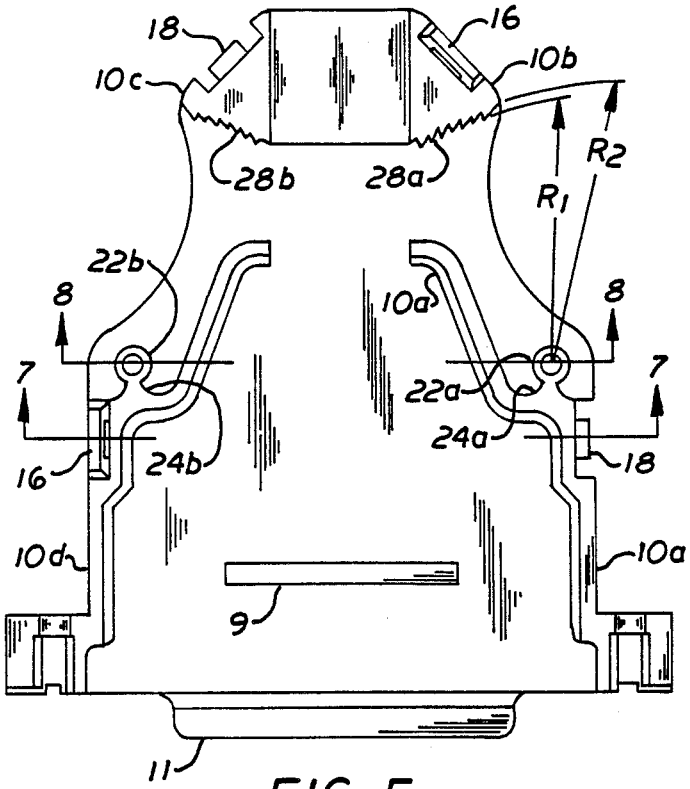
FIG. 5 is a plan view of one of the housing portion of the connector of FIG. 1, illustrating the internal configuration thereof.

While it is not required in order to practice this invention, the housing 2 comprising this hood may most advantageously be formed of two identical, mirror-image housing portions 6 and 6′ that mate together. Similarly, it is desirable, although not required, that the two gripper elements 4*a* and 4*b* likewise be identical. In this matter it may be necessary to utilize only two molds for fabricating all four parts of the hood assembly, one mold for the two gripper elements 4*a* and 4*b* and one mold for the two housing portions 6 and 6′. Because in this preferred embodiment the two housing portions 6 and 6′ are substantially identical, only a single such housing portion 6 is illustrated in FIGS. 3, 4 and 5.

As shown most clearly in FIGS. 5 through 8, housing portion 6 (and mating portion 6′ not shown) suitably may be formed with a broad first side portion 8 having lateral edge portions 10*a*, 10*b*, 10*c* and 10*d* extending outwardly therefrom and preferably being molded as a single unit therewith. As shown in FIGS. 1 and 2 the lateral edge portions of each housing portion matingly engage to define the lateral edge portions of the housing extending between the side portions 8 and 8′.

The combined lateral edge portions 10*a* and 10*d* may be considered as jointly comprising a first set of lateral edge portions, or a first such lateral edge portion. Similarly, the combination of lateral edge portions 10*b* and 10*c* may be considered as defining a second such lateral edge portion. Preferably by molding in an appropriate configuration, the housing provides, suitably but not necessarily at opposite ends thereof, a first aperture provided between, or through, lateral edge portions 10*a* and 10*d* and a second aperture, suitably provided through or between lateral edge portions 10*b* and 10*c*. This first aperture provides, as shown in FIGS. 3 and 4 for reception within the hood of an appropriate cable connector 12, shown in phantom. The housing portion 6 may include as integrally molded therwith tabs or bosses 11 and 13 for engaging the connector 12 and holding it secure when the housing portions 6 and 6′ are assembled. This cable connector 12 may, for example, be of the type known as an AMPLIMITE 25 Position Connector such as sold by AMP Special Industries. The second aperture may then define a cable channel for receiving a cable portion 14 (shown in phantom in FIGS. 3 and 4) which may be connected to the connector 12. This cable channel thus provides not only for the entry of the cable portion 14 into the housing but also serves to restrain within the housing the movement of the cable 14 transverse to the length of the cable.

Figure 6:
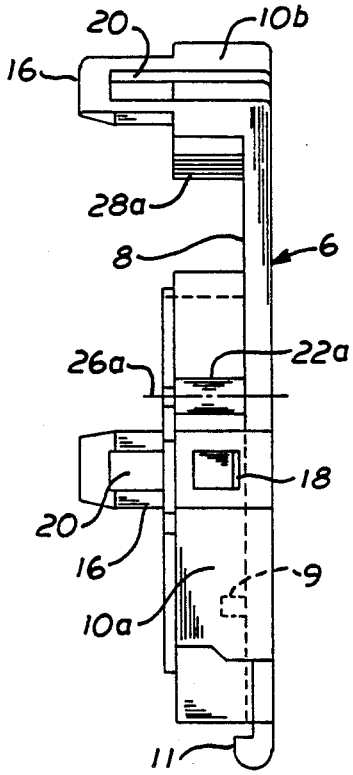
FIG. 6 is a side elevation of the housing portion of FIG. 5.
Figure 7:
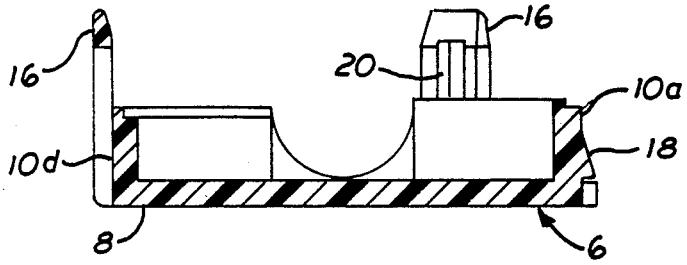
FIG. 7 is a sectional view taken along line 7—7 of FIG. 5.
Figure 8:
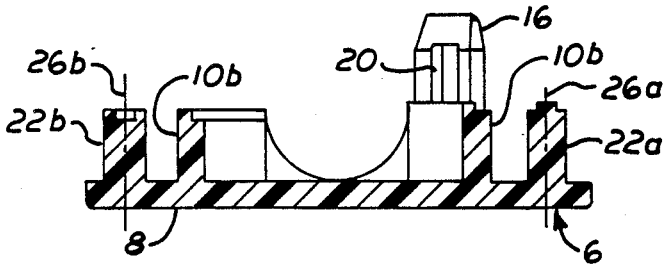
FIG. 8 is a sectional view taken along line 8—8 of FIG. 5.

As shown most clearly in the side elevation of FIG. 6, each housing portion has associated therewith joining means engagable with the mating housing portion for maintaining those two housing portions in the mating engagement shown in FIGS. 1 and 2. Preferably these housing portion joining means may comprise a plurality of slotted tabs 16 and correspondingly positioned bosses 18, and may suitably be molded integrally with the respective housing portions 6 and 6′. In the illustrated embodiment each such housing portion includes two such joining tabs 16 and two such bosses 18. The tabs 16 on each of the mating housing portions are positioned to joiningly engage the bosses 18 on the opposed housing portion, with the slots 20 of each such tab 16 capturing the respective mating boss 18. In this manner the two housing portions may be snapped together with the engagement between the slotted tabs 16 and the bosses 18 thus maintaining that joining of the housing portions 6 and 6′ into a single housing 2.

Carried by at least one of the housing portions 6, and preferably in this embodiment by both such portions 6 and 6′, is at least one pivot support 22*a*. Preferably, as shown in illustrated embodiment in FIGS. 3–5, each such housing portion carries two such pivot supports 22*a* and 22*b*. Each of these pivot supports 22*a* and 22*b* is spaced from, suitably on opposite sides of, the cable channel through which enters the cable portion 14, as shown in FIGS. 3 and 4. These pivot supports 22*a* and 22*b* may suitably be molded integrally with the respective housing portion, and may preferably be joined to part of the respective lateral edge portions 10*a* and 10*b* by neck-like portions 24*a* and 24*b*, as shown most clearly in FIG. 5. These necks portions 24*a* and 24*b* provide additional strength for the respective pivot support 22*a* and 22*b*. Each of these pivot supports 22*a* and 22*b* has a pivot axis 26*a* and 26*b* extending through the center of the pivot support and generally normal to the first side portion 8 of the housing portion 6.

Also carried by at least one of the housing portions 6 are detent means 28*a*, suitably in the form of a group of generally parallel ridges extending generally parallel to and in a direction toward the pivot support 22*a* and outwardly of at least one lateral edge portion 10*b* of the housing portion 6. In this preferred embodiment additional such detent means 28*b*, in the form of a group of generally parallel ridges, extend outwardly of the lateral edge portion 10*c* in a direction generally parallel and in a direction toward the pivot 22*b*. As illustrated in FIG. 5, the outermost extension of each ridge of the group 28*a* is spaced a distance from the pivot support axis 22*a* substantially equal to the distance of each other such ridge outermost extension, so that the group of ridges defines a generally arcuate pattern about the axis 26*a* of the pivot support 22*a*. As shown most clearly in FIG. 5, the height of the extension of each such ridge of the group 28*a* outwardly from the lateral edge portion is defined by the difference between the radii R1 and R2, respectively indicating the distance from the pivot axis 26*a* of the outermost extension and the base of each such ridge. Preferably, for reasons to be described more fully below, the height of the extension of the extension of each such ridge defined by the differences between R1 and R2, is at least 0.02 inch and desirably on the order of 0.03 inch.

Figure 9:
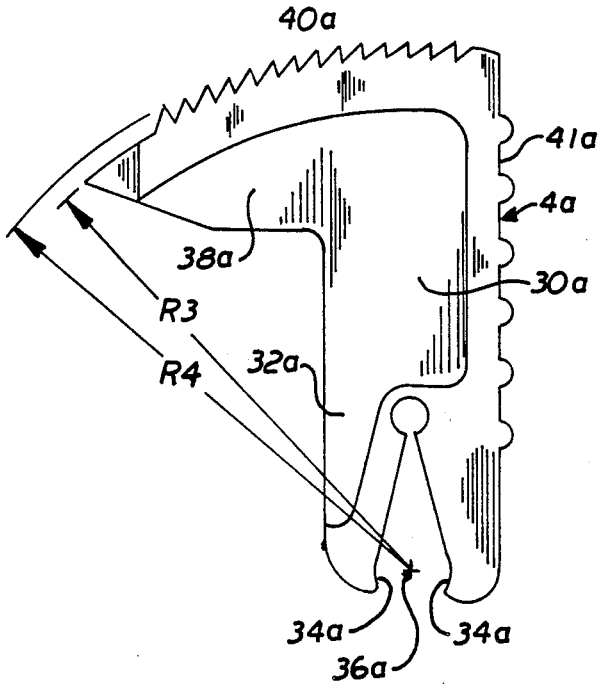
FIG. 9 is a plan view of one of the gripper elements of FIG. 3.
Figure 10:
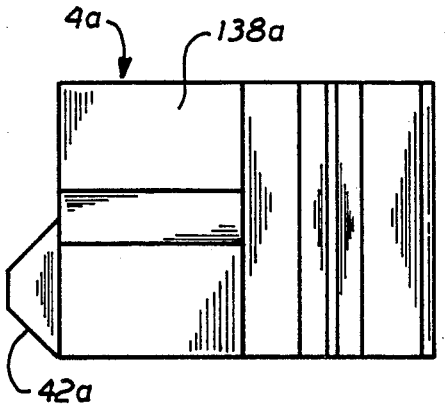
FIG. 10 is a end elevational view of the gripper element of FIG. 9.

With reference to FIGS. 3 and 4, the hood includes at least one gripper element 4*a* pivotably receivable onto the housing portion pivot support 22*a*. In the illustrated embodiment the hood assembly preferably includes two such gripper elements 4*a* and 4*b*, pivotably receivable onto the respective pivot supports 22*a* and 22*b*. The gripper element 4*a*, illustrated on a larger scale and in more detail in FIGS. 9 and 10, comprises a member 30*a* having a first portion 32*a* carrying pivot means 34*a*. This pivot means 34*a* is suitably in the form of pivot jorrnal having a predetermined pivot axis 36*a* that engages the housing portion pivot support 22*a* generally as shown in FIGS. 3 and 4. In such engaged relationship, the gripper member pivot axis 36*a* is substantially coaxial with the pivot support axis 26*a*.

The gripper element member 30*a* also includes a second, generally opposing portion 38*a* carrying detent engaging means 40*a*, suitably in the form of a plurality of ridges. These ridges 40*a* are preferably arranged in the form of a group of generally parallel ridges extending outwardly from the gripper element member second portion 38*a* for resilient mating engagement with the housing detent means ridges 28*a* when the gripper element is pivotally supported upon the housing portion pivot support 22*a* in the manner shown in FIGS. 3 and 4. Similar to the housing portion detent ridges 28*a*, the outermost extension of each gripper element detent engaging means ridge extends a distance from the gripper element pivot axis 36*a* substantially equal to the distance of each other such gripper element detent engaging means ridge outermost extension, so that the group of ridges 40*a* defines a generally arcuate pattern on the gripper element second portion, substantially concentric with the gripper element pivot axis 36*a*. Also, to facilitate mating engagement with the detent ridges 28*a* of the housing portion 6, the height of the extension of each such gripper element detent engaging means ridge outwardly of the second portion 38*a* of the gripper element member 30*a* is desirably at least 0.02 inch and preferably on the order of 0.03 inch, as defined by the differences between the radii R3 and R4 shown on FIG. 9.

In the preferred embodiment of the hood as illustrated, the housing detent means comprises two such groups of generally parallel ridges, 28*a* and 28*b* with the ridges of each respective group extending generally parallel to and in a direction toward the pivot axis of respective pivot supports 22*a* and 22*b*. These ridges extend outwardly of the respective lateral edge portions 10*b* and 10*c* from at least the one housing portion 6, as illustrated, and preferably both such housing protions 6 and 6'.

To urge the detent engaging means 40*a* of the gripper element 4*a* into mating engagement with the detent means ridges 28*a* while still permitting passage of the gripper element ridges past the housing detent means ridges, the gripper element 4*a* is provided with resilient biasing means urging those ridges 40*a* into mating engagement with the housing ridges 28*a*. In the gripper element embodiment of FIGS. 9 and 10 this resilient biasing means comprises an arrangement permitting resilient deflection of the position of the gripper element pivot axis 36*a* relative to the gripper element member 30*a*. This conveniently can be accomplished by forming the journal of that member 30*a*, that engages the shaft defined by the housing member pivot support 22*a*, of two connected journal portions 34*a* and 34*a*', with a resilient connection therebetween. This resilient connection may suitably comprise the synthetic resin material from which the gripper element 4*a* is molded. This resilient connection thus resiliently urges the journal portions 34*a* and 34*a*' into the predetermined relationship illustrated in FIG. 9, defining the normal position of the gripper element pivot axis 36*a* relative to the member 30*a* while permitting resilient deflection of the journal portions 34*a* and 34*a*' and thus such resilient deflection of the relative positions of the gripper element pivot axis 36*a* with respect to the member 30*a*. This resilient deflection of the gripper element relative to the pivot support 22*a* thus facilitates movement of the gripper element teeth 40*a* past the housing portion teeth 28*a*, while urging those two elements and their respectively mating teeth into engagement.

Figure 11:
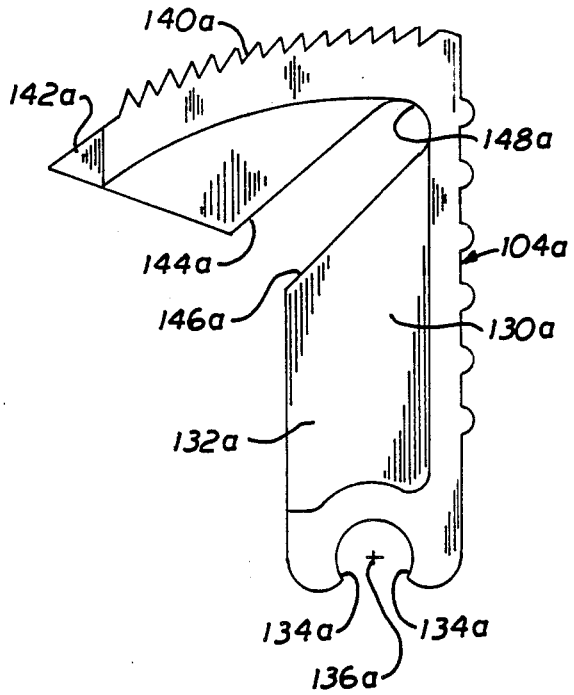
FIG. 11 is a plan view of an alternative configuration of gripper element.

FIG. 11 illustrates an alternative configuration of the gripper element of this invention. For clarity of explanation, and because most of the components of the alternative gripper element 104*a* of FIG. 11 are substantially the same as those shown in FIGS. 3, 4 and 9, corresponding reference numbers increased by 100 are utilized to indicated corresponding portions thereof. The primary differences between this gripper element 104*a* and the previously described gripper element 4*a* lie in the pivot means journal 134*a* and the resilient biasing arrangement. In gripper member 104*a* the pivot axis 136*a* thereof is fixed and does not move resiliently as in the gripper element 4*a*. Instead, the resilient biasing arrangement for the detent engaging means ridges 140*a* is provided a the slot, the edges of which are defined by reference numerals 144*a* and 146*a*, in the second portion of the elongated member 130*a*. Thus, the second portion 138*a* of the gripper element elongated member 130*a* is joined to the first portion 132*a* by that resilient section of reduced thickness indicated by reference number 148*a*. This permits the second portion 138*a* to be resiliently deflected about the reduced thickness portion 148*a* relative to the member first portion 132*a*. Thus, the functioning of this alternative embodiment of the gripper element is substantially similar to that illustrated in FIGS. 3, 4, 9 and 10. From this embodiment it should also be apparent that the shaft and journal components providing for pivoting of the gripper elements could, if desired, be interchanged between the gripper element member and the housing portions without loss of function.

While this invention provides for at least one gripper element 40*a* carried on at least one pivot support 22*a* and engaging detent means 28*a*, it is preferred that there be two opposing sets of such elements, as shown in FIGS. 3 and 4, so that the hood is substantially symmetrical on opposite sides of the cable channel. Thus, there preferably are provided two such pivot supports 22*a* and 22*b* substantially parallel to one another in carrying two such gripper elements 40*a* and 40*b*. Further, it is preferred that the two housing portions 6 and 6' each carry portions of the two pivot supports 22*a* and 22*b* so that each of the two mating housing portions 6 and 6' support the two gripper elements. Preferably the two housing portions 6 and 6' are substantially identical, mirror-images of one another, as are the two gripper elements 4*a* and 4*b*. Thus, the two gripper elements 4*a* and 4*b* may be positioned on the pivot supports 22*a* and 22*b* of one of the housing portions 6 with those gripper elements initially positioned away from, or just adjacent the cable channel, as shown in FIG. 3. Then, the desired cable connector 12 connected to its respective cable portion 14 may be laid in place, as shown in FIG. 3, with the other housing portion 6' then snapped onto housing portion 6, to complete the connector hood assembly.

With the hood assembly then joined as described above, the gripper element or elements may then be brought into gripping engagement with the cable portion 14 as shown in FIG. 4. Due to the resilient biasing means urging the gripper element detent engaging means ridges 40*a* and 40*b* into mating engagement with the housing detent means ridges 28*a* and 28*b*, simple hand pressure exerted on the outside surfaces 41*a* and 41*b* of the gripper elements 4*a* and 4*b* will pivot those gripper elements inwardly about the pivot axes 22*a* and 22*b*. The resilient biasing arrangement permits the gripper element ridges 40*a* and 40*b* to be moved resiliently away from the housing detent means ridges 28*a* and 28*b* to permit the desired pivoting under the manual pressure. This pivoting thus brings into engagement with the cable portion 14 the projections 42*a* of the gripper 4*a* (and 42*b* of the gripper 4*b* where so provided). This projection 42*a* is illustrated more clearly in FIGS. 9, 10 and 11 and serves to provide highly localized gripping contact with the cable portion 14, as shown in FIG. 4. This projection 42 extends inwardly of the housing when the gripper element 4*a* is pivotally supported upon the pivot support 22*a*. When both gripper elements 4*a* and 4*b* of the preferred embodiment are pivoted inwardly, these projection 42*a* and 42*b* thus grip the cable 14 in the manner shown in FIG. 4.

While the housing detent means ridges 28*a* and 28*b* and the gripper element detent engaging means ridges 40*a* and 40*b* may be formed at any suitable angle, it is preferred that they be provided with the "saw-tooth" configuration shown in the illustrations. In this configuration the side of each such ridge facing away from the cable channel extends substantially in the direction radially from the respective pivot axes 26*a* and 36*a* with respect to gripper 4*a* and radially from pivots 26*b* and 36*b* with respect to gripper element 4*b*. The other side of each ridge, the side toward the cable channel, is thus angled. This provides for ratcheting movement of the gripper element inwardly of the housing, toward the cable channel, while strongly resisting any return pivoting of the respective gripper elements outwardly of the hood housing. Such a detent arrangement provides for a particularly secure engagement between the hood and the cable.

From the foregoing it may be seen that the cable connector hood of the present invention provides not only a simplified apparatus but one in which the pivoting cable gripper element provides a firm gripping engagement of the cable portion used therewith. This firm gripping engagement thus helps prevent potentially damaging stresses from being conveyed from the cable outside the hood to the relatively delicate connections between the cable wires and the connector with which it is used. An additional benefit of the preferred embodiment of this invention is the capability of complete assembly of the hood arrangement, including gripping engagement with the cable portion, without the use of any tools other than the assembler's fingers. Of course, it is to be understood that numerous other variations and embodiments of this invention beyond those illustrated and described, all encompassed within the scope of this invention, will readily occur to those skilled in the art. Thus, the described embodiments are to be considered only as illustrative of the principles of the invention and are not to be considered limitative thereof. The scope of this invention is to be limited solely by the claims appended hereto.

What is claimed is:

1. A hood for receiving and partially enclosing an electronic cable connector and for grippingly engaging a portion of an electronic cable connected to such connector, said hood comprising a housing for receiving and partially enclosing said cable connector, said housing having two spaced apart and generally opposed first side portions with lateral edge portions extending therebetween, with a first aperture through a first said lateral edge portion for receiving said cable connector and a second aperture through a second said lateral edge portion for defining a cable channel and receiving said cable portion therethrough while restraining within said housing the movement of said cable transverse to the length of said cable, said housing comprising two mating housing portions each including one of said first side portions and part of said lateral edge portions;

housing portion joining means engageable with said housing portions for maintaining said housing portions in mating engagement with one another;

at least one pivot support carried by at least one said housing portion and spaced from said cable channel, said pivot support having a pivot axis extending generally normal to said one housing portion first side portion;

detent means carried by at least one said housing portion and spaced from said pivot support, said housing detent means comprising a group of generally parallel ridges extending generally parallel to and in a direction toward said pivot support axis and outwardly of one of said lateral edge portions of at least one said housing portion; and at least one gripper element pivotably receivable onto said housing portion pivot support and comprising a member having a first portion carrying pivot means pivotally engaging said housing portion pivot support and having a predetermined pivot axis; and a second generally opposing portion carrying detent engaging means for resiliently engaging said housing portion detent means when said gripper element is pivotally supported said housing portion pivot support and having an outer extremity thereof for engaging said cable portion;

said gripper element being pivotable about said housing portion pivot support inwardly of said housing portions into gripping engagement with said cable portion.

2. The hood of claim 1 wherein at least a portion of said pivot support is carried by each of said two housing portions, whereby said gripper element is pivotally supported by both housing portions.

3. The hood of claim 1 wherein the outermost extension of each said ridge is spaced a distance from said pivot support axis substantially equal to said distance of each other said ridge outermost extension, whereby the group of ridges defines a generally arcuate pattern.

4. The hood of claim 1 wherein the height of said extension of each said ridge outwardly from said one lateral edge portion is at least 0.02 inch.

5. The hood of claim 1 wherein said gripper element detent engaging means comprises a group of generally parallel ridges extending outwardly from said member second portion for mating engagement with said housing detent means ridges when said gripper element is pivotally supported upon said housing portion pivot support.

6. The hood of claim 5 wherein the outermost extension of each said gripper element detent engaging means ridge is spaced a distance from said gripper element pivot means axis substantially equal to said distance of each other said gripper element detent engaging means ridge outermost extension, whereby the group of ridges defines a generally arcuate pattern.

7. The hood of claim 5 wherein said gripper element further comprises resilient biasing means urging said gripper element detent engaging means ridges into mating engagement with said housing detent means ridges while permitting resilient deflection of at least a portion of said gripper element to permit passage of said gripper element detent engaging means ridges past said housing detent means ridges when said gripper element is moved pivotally about said pivot means axis.

8. The hood of claim 7 wherein said gripper element resilient biasing means comprises means permitting resilient deflection of the position of said gripper element pivot axis relative to said gripper element member.

9. The hood of claim 8 wherein said housing pivot support comprises shaft means, and said gripper element pivot means comprises journal means formed of at least two connected journal portions for receiving said housing pivot support shaft means and said gripper element resilient biasing means comprises means resiliently urging said journal portions into a predetermined relationship defining the position of said gripper element pivot axis relative to said gripper element elongated member while permitting resilient deflection of said journal portions and thus of said relative position of said gripper element pivot axis.

10. The hood of claim 7 wherein said gripper element resilient biasing means comprises means resiliently joining said second portion of said gripper element member carrying said detent engaging means to said first portion of said gripper element member carrying said pivot means, whereby the gripper element member second portion may be deflected relative to the first portion thereof.

11. The hood of claim 5 wherein the height of said extension of each of said gripper element detent means ridge outwardly of said gripper element second portion is at least 0.02 inch.

12. The hood of claim 5 wherein said housing detent means ridges and said gripper element detent engaging means ridges are each angled to facilitate pivoting of said gripper element inwardly of said housing and to resist pivoting of said gripper element outwardly of said housing.

13. The hood of claim 1 wherein said housing includes two said pivot supports with the pivot axes thereof being substantially parallel to one another and carried by at least one said housing portion, and wherein said hood includes two said gripper elements with a respective one of said gripper elements pivotably receivable onto each of said two pivot supports.

14. The hood of claim 13 wherein at least a portion of each of said two pivot supports is carried by each of said two housing portions, whereby each of the two gripper elements is pivotally supported by both housing portions.

15. The hood of claim 13 wherein said housing detent means comprises two groups of generally parallel ridges with the ridges of each respective group extending generally parallel and in a direction toward said pivot axis of a respective one of said two pivot supports and outwardly of one of two respective lateral edge portions of at least one said housing member.

16. The hood of claim 1 wherein an outer extremity of said gripper element member second portion projects inwardly of said housing when said gripper element is pivotally supported upon said housing pivot support and projects toward said cable channel and wherein said gripper element member second portion outer extremity includes, projecting toward said cable channel, cable engaging means for contacting and grippingly engaging said cable portion when said gripper element is pivoted about said housing pivot support in a direction inwardly of said housing.

* * * * *